US006127079A

United States Patent [19]

Sumiyoshi et al.

[11] Patent Number: 6,127,079

[45] Date of Patent: Oct. 3, 2000

[54] CARRIER FOR ELECTROSTATIC LATENT IMAGE DEVELOPING AND TWO-COMPONENT-TYPE DEVELOPING AGENT USING THE SAME

[75] Inventors: Tadao Sumiyoshi, Matsubara; Tomohide Iida, Osaka, both of Japan

[73] Assignee: Kyocera Mita Corporation, Osaka, Japan

[21] Appl. No.: 09/461,426

[22] Filed: Dec. 16, 1999

[30] Foreign Application Priority Data

Dec. 24, 1998 [JP] Japan ..... 10-365935

[51] Int. Cl.[7] ..... G03G 9/113

[52] U.S. Cl. ..... 430/108; 430/106.6; 430/111

[58] Field of Search ..... 430/108, 111

[56] References Cited

U.S. PATENT DOCUMENTS

| | | | |
|---|---|---|---|
| 4,584,254 | 4/1986 | Nakayama et al. | 430/108 |
| 4,927,728 | 5/1990 | Isoda et al. | 430/108 |
| 5,731,120 | 3/1998 | Tanigami et al. | 430/108 |
| 5,766,814 | 6/1998 | Baba et al. | 430/111 |
| 5,885,742 | 3/1999 | Okado et al. | 430/111 |

FOREIGN PATENT DOCUMENTS

| | | | |
|---|---|---|---|
| 0408399 | 7/1989 | European Pat. Off. . | |
| 0926566 | 6/1999 | European Pat. Off. . | |
| 58-174958 | 10/1983 | Japan | 430/108 |
| 58-184951 | 10/1983 | Japan | 430/108 |
| 62-182752 | 8/1987 | Japan | 430/108 |
| 6-118725 | 4/1994 | Japan | 430/108 |

*Primary Examiner*—Roland Martin

[57] ABSTRACT

A two-component-type developing agent comprising a silicone resin-coated carrier and a positively charging toner, the silicone coated carrier having an average particle diameter of from 60 to 110 $\mu$m, the silicone resin coating having an average thickness of from 0.1 to 0.3 $\mu$m, the carrier having a resistivity of from $1.5\times10^{8}$ to $1.5\times10^{11}$ $\Omega\cdot$cm, the toner concentration being from 3.0 to 5.0 % by weight and the amount of electric charge by friction of the toner based on the suction method being from +10 to +20 $\mu$c/g. The silicone resin-coated carrier and the developing agent feature long life without permitting the spent toner to adhere on the carrier surfaces, without permitting the carrier coating to peel off even after repetitively used for extended periods of time, featuring stable amount of electric charge by friction, stable developing properties, and maintaining favorable image quality for extended periods of time developing none of carrier dragging, toner scattering in the machine, background fogging or defective image density.

4 Claims, 4 Drawing Sheets

MEASURING PART OF THE MEASURING SYSTEM

CARRIER FOR ELECTROSTATIC LATENT IMAGE DEVELOPING AND TWO-COMPONENT-TYPE DEVELOPING AGENT USING THE SAME

BACKGROUND OF THE INVENTION

1. Field of the Invention

The present invention relates to a carrier for developing electrostatic latent image formed by electrophotography and to a two-component-type developing agent using this carrier.

2. Disclosure of the Prior Art

Image-forming machines based on the electrophotographic method, such as electrostatic copier, laser printer and the like machines, use a two-component-type developing agent that contains a toner for developing electrostatic latent image on the surface of the photosensitive material and a magnetic carrier that electrically charges the toner by friction and turns in a developing device in a state of adsorbing the toner to supply the toner to the photosensitive material.

In order to prevent the adhesion of spent toner on the carrier and to adjust the charging properties, the surfaces of the carrier have generally been coated with a styrene-acrylic resin, acrylic resin, styrene resin, silicone resin, acrylic-modified silicone resin or fluorine-contained resin. As the coating resin having good property against being spent, there can be exemplified a silicone resin and a fluorine-contained resin having low surface tension. The fluorine-contained resin tends to be negatively charged and can be favorably used as a toner of the positively charging type, but easily peels off the carrier cores due to its poor bonding property and is not easy to use. The silicone resin exhibits excellent property against being spent and excellent bonding force to the carrier cores. When applied in large amounts, however, the silicone resin causes the carrier resistance to increase and the image density to decrease. When applied in small amounts, on the other hand, the silicone resin peels off after repetitively used, causing the life of the developing agent to be shortened. Thus, it is difficult to apply the silicone resin in proper amounts.

In order to improve the image quality and to extend the life of the developing agent by decreasing the scattering of toner, it is important that the toner is electrically charged by friction in amounts within a proper range without changing even after used for extended periods of time. In general, when the amount of electric charge by friction is not larger than +10 $\mu$c/g, a sufficiently large image density is obtained but the toner easily separates away from the carrier and scatters to cause fogging. When the amount of charge by friction is not smaller than +20 $\mu$c/g, the toner does not scatter but the image density is not sufficient.

To satisfy these requirements, there has been proposed a two-component-type developing agent of a combination of a positively charging toner and a silicone-coated carrier having an average particle diameter of from 40 to 60 $\mu$M (Japanese Unexamined Patent Publication (Kokai) No. 43910/1997). However, there exists an intimate relationship between the particle diameter of the carrier and the so-called carrier dragging or the carrier-flying phenomenon. It has been known that the carrier having a particle diameter of as small as 44 $\mu$m or less in the whole carrier tends to adhere onto the photosensitive material due to the electrostatic sucking force by the photosensitive material overcoming the magnetic locking force by the developing sleeve and due to a repulsive force produced by a bias voltage from the developing sleeve.

Usually, the particle diameter of the carrier is adjusted by sieving using a mesh. It is, however, difficult to remove the particles of diameters not larger than 44 $\mu$m while maintaining the average particle diameter to be from 40 to 60 $\mu$m. The carrier having particle diameters of from 40 to 60 $\mu$m generally exhibits a low fluidity. When the developing agent having an increased toner density is used to obtain a sufficiently large image density, the fluidity of the developing agent decreases. Therefore, the replenished toner is poorly mixed and the toner is electrically charged in decreased amounts; i.e., the toner scatters and causes fogging. As the copying speed increases, the replenished toner is mixed less. Therefore, this two-component-type developing agent has not been widely used in high-speed machines.

OBJECTS AND SUMMARY OF THE INVENTION

It is therefore an object of the present invention to provide a two-component-type developing agent of a combination of a positively charging toner and a resin-coated carrier, which stably maintains the amount of electric charge by friction at a suitable level from the beginning even after repetitively used for extended periods of time, and a carrier for electrostatic latent image developing used for the two-component-type developing agent, by solving the above-mentioned problems inherent in the prior art.

According to the present invention, there is provided a carrier for electrostatic latent image developing having a resin coating of a cured product of a silicone resin applied onto the surfaces of carrier cores, the average particle diameter thereof being from 60 to 110 $\mu$m, the thickness of the resin coating being from 0.1 to 0.3 $\mu$m, the volume specific resistance thereof being from $1.5\times10^{8}$ to $1.5\times10^{11}$ $\Omega$·cm, and the amount of electric charge by friction being from −10 to −20 $\mu$c/g. It is particularly desired that the carrier contains not larger than 2% by weight of particles having diameters of not larger than 44 $\mu$m.

According to the present invention, there is further provided a developing agent for electrostatic latent image, which is a two-component-type developing agent comprising a silicone resin-coated carrier and a positively charging toner, said silicone resin-coated carrier having an average particle diameter of from 60 to 110 $\mu$m, the thickness of the resin coating being from 0.1 to 0.3 $\mu$m, and the volume specific resistance thereof being from $1.5\times10^{8}$ to $1.5\times10^{11}$ $\Omega$·cm, and said positively charging toner having the amount of electric charge by friction being from 10 to 20 $\mu$c/g. It is desired that the developing agent contains the positively charging toner in an amount of from 3.0 to 5.0% by weight.

DETAILED DESCRIPTION OF THE INVENTION (Carrier)

Figure 1:
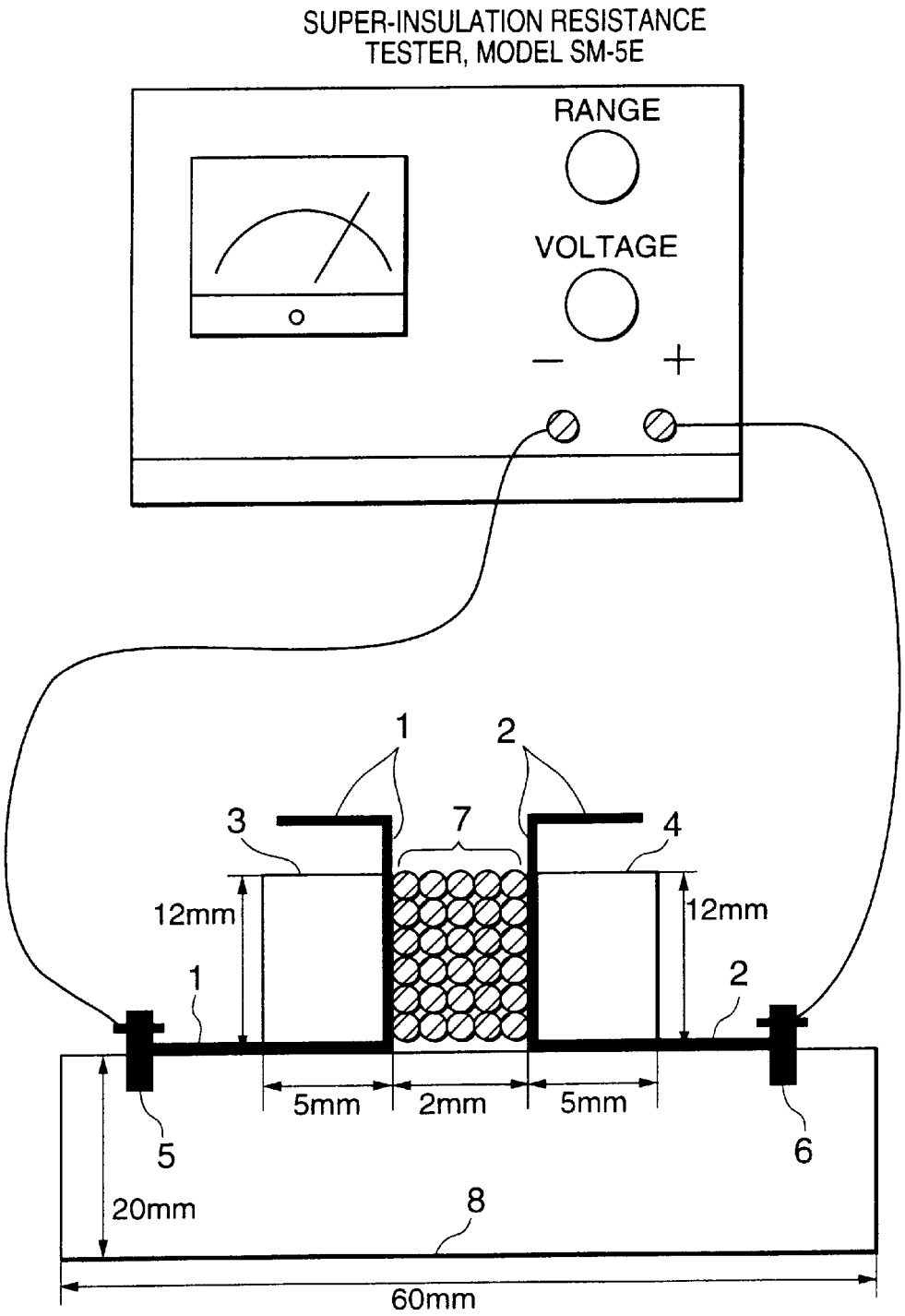
FIG. 1 is a schematic diagram of when an electric resistance-measuring apparatus for measuring the carrier resistance is viewed from the front.

The carrier of the present invention comprises magnetic particles serving as carrier cores coated with a cured product of a silicone resin.

The carrier cores are coated with the silicone resin because the silicone resin stably maintains the amount of electric charge even after used repetitively and enables the life of the developing agent to be lengthened.

It is desired that the resin coating has a thickness of from 0.10 to 0.30 $\mu$m. An increase in the thickness of the coating causes the charging characteristics to be deteriorated and the electric resistance to increase. A decrease in the thickness of the coating causes the amount of electric charge to increase and the electric resistance to decrease.

When the thickness of the coating is smaller than 0.10 $\mu$m, a satisfactory image density (ID) is obtained, but there occurs the forward carrier dragging phenomenon, scattering of the toner and fogging in a highly humid environment. This is because, though the amount of initial charge is great, the developing electrode effect of the developing agent becomes too great since the volume specific resistivity is smaller than $1.5\times10^7$ Ω·cm, whereby the toner amount for developing amount increases excessively and the toner of the developing agent partly falls on the image in a direction in which the magnetic brush slides causing the image to be blurred. After repetitively used for extended periods of time, further, the coating peels off permitting the surfaces of the cores to be exposed. This spoils the effect against being spent, permits the amount of electric charge to decrease and permits the durability to be lost. Further, the carrier receives electric charge from the toner, and is developed together with the toner on the image portion, and the thus adhered carrier remains on the photosensitive material without being transferred. When passing through the cleaning blade, therefore, the photosensitive material is scratched to form stripes; i.e., the black-striped copy fouling occurs continuously. Besides, since the adhered carrier thickly exists between the photosensitive material and the transfer paper, the toner on the image portion is not transferred over some range with the carrier as a center, and white spots occur.

When the thickness of the coating exceeds 0.30 $\mu$m, it becomes difficult to suppress the carrier resistance to be not larger than $1.5\times10^{11}$ Ω·cm, and the image density decreases. Further, since the charge rising performance (ratio of the amount of electric charge at the beginning of the mixing to the saturated amount of electric charge) decreases, the amount of electric charge gradually decreases after repetitively used, and the toner easily scatters and causes fogging.

The thickness of the resin coating is found from the following formula by using the specific surface area of the carrier ($cm^2/g$), amount of resin coating (g) per a gram of the carrier, and the specific gravity of the resin (≈1 $g/cm^3$).

Thickness of the resin coating (cm)=[amount of resin coating (g/carrier g)/specific gravity of resin ($g/cm^3$)]/specific surface area ($cm^2/g$)

In the present invention, the specific surface area of the carrier was measured by using the Cantasorb (BET measuring apparatus manufactured by Yuasa Ionics Co., Ltd. which is briefly described in a Handbook of Powdery Fluid Measurement, pp. 101–102, published by Nikkan Kogyo Shinbunsha).

In the present invention, further, it is important that the average particle diameter of the silicone-coated carrier lies over a range of from 60 to 110 $\mu$m.

Compared to the carrier having an average particle diameter of smaller than 60 $\mu$m, the carrier of the present invention having an average particle diameter over the above-mentioned range exhibits the following advantages.

First, the carrier of the present invention has a small specific surface area, exhibits excellent fluidity, and is dispersed well in the step of applying the resin. Therefore, the carrier particles are uniformly coated with the resin with ease. In the step of heat treatment, the carrier particles are coagulated little, heat is favorably conducted to the carrier particles, and the coating having a decreased thickness is strongly bonded. Second, small mechanical stress is produced by the mixing and stirring in the developing device during the copying operation, and the coating is hardly peeled off. Third, the carrier exhibits high fluidity, has a small specific surface area, and enables the developing agent to be used at a low toner concentration. Owing to these synergistic effects, the toner is favorably mixed into the developing agent and scatters less. Fourth, the carrier is prevented from adhering onto the photosensitive material.

When the carrier has an average particle diameter of smaller than 60 $\mu$m, the particles having diameters of not larger than 44 $\mu$, which are difficult to remove, tend to adhere onto the photosensitive material arousing problems as described below. When the adhered carrier is not transferred but remains on the photosensitive material, the photosensitive material is scratched to form stripes as the carrier is rubbed by the blade in the cleaning portion, and the black striped copy fouling occurs continuously. Besides, since the adhered carrier thickly exists between the photosensitive material and the transfer paper, the toner on the image portion is not transferred over some range with the carrier as a center, and white spots occur. When the average particle diameter of the carrier exceeds 110 $\mu$m, limitation is imposed on the effective specific surface area of the carrier, and the replenished toner that is poorly charged causes fogging and scatters.

In the present invention, the average particle diameter of the carrier is a median diameter based on the sieving method (Handbook of Measurement of Powdery particles, pp. 52–54, published by Nikkan Kogyo Shinbunsha). The sieving was effected by using five kinds of meshes having nominal sizes of 44, 63, 74, 105 and 149 $\mu$m, and an Ro-Tap shaker.

It is also important that the carrier of the present invention has a carrier resistance, in terms of a volume specific resistivity, of from $1.5\times10^8$ to $1.5\times10^{11}$ Ω·cm and, particularly, from $6\times10^8$ to $1\times10^{10}$ Ω·cm.

Figure 2:
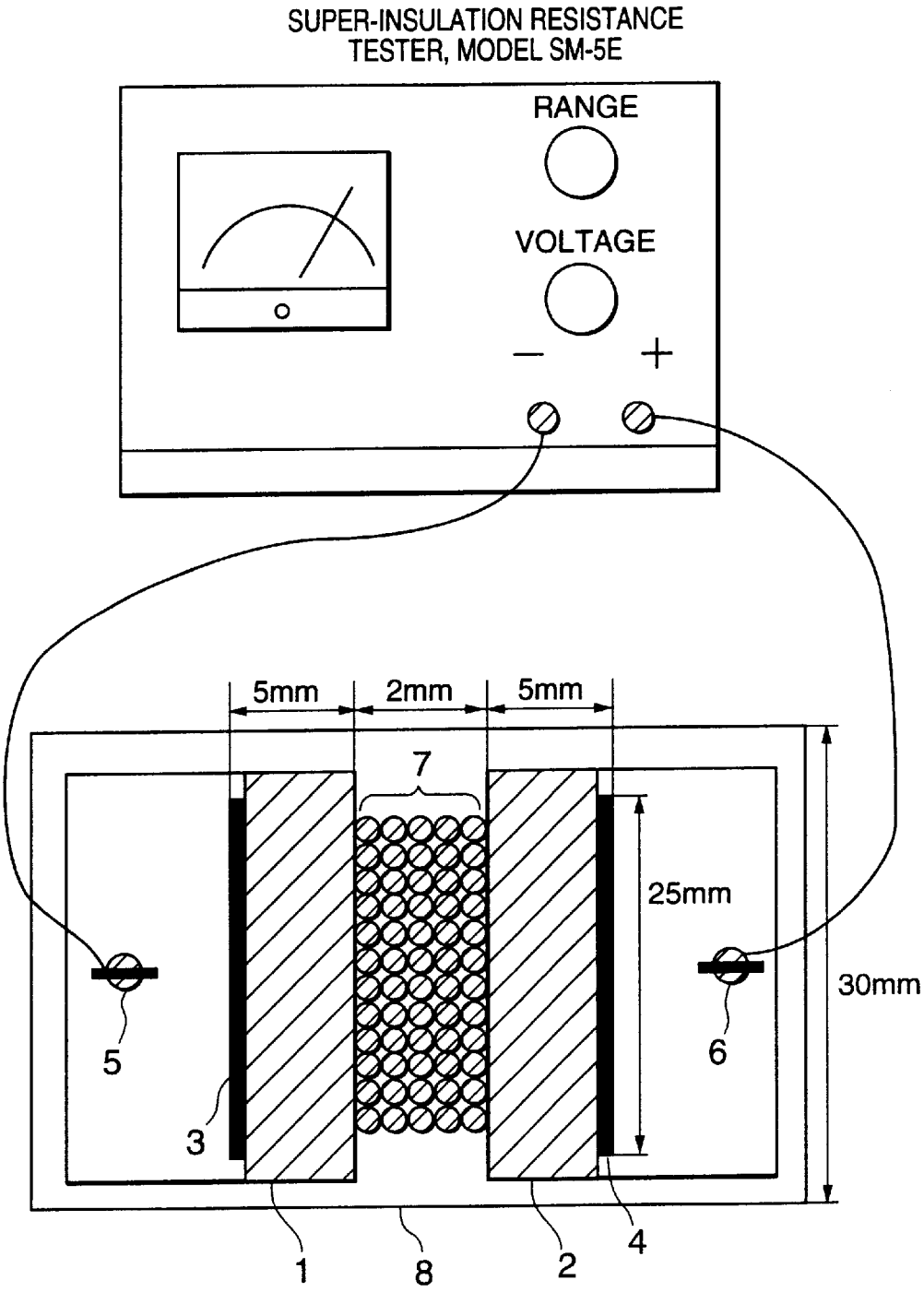
FIG. 2 is a schematic diagram of when an electric resistance-measuring apparatus for measuring the carrier resistance is viewed from the above

According to the present invention, the carrier resistance can be measured by using a bridge-type electric resistance measuring device and a super-insulation resistance tester, Model SM-5E (manufactured by Toa Electronics Ltd.) shown in FIGS. 1 and 2. A static resistance is measured in a state where the carrier particles are linked like a chain in a magnetic field. Therefore, the electric resistance of the carrier is approximated to the magnetic brush and is measured without affected by the developing conditions. For easy comprehension of the drawings, the sizes on the drawings are only rough indications. As shown, copper electrode plates ① and ② are secured in parallel on the upper surface of an acrylic resin board ⑧ maintaining a gap of 2.0 mm. On the back sides of the copper electrodes ① and ② are arranged magnets of 1000 gausses to form an electric field between the electrodes. A carrier sample of an amount of 0.2 g is set between the electrodes, and is filled to acquire a chain structure in compliance with the lines of magnetic force as denoted by ⑦. Ten seconds after the application of a DC voltage of 1000 V across the terminals ⑤ and ⑥, the electric resistance of the carrier is read by using the super-insulation resistance tester, Model SM-5E, (manufactured by Toa Electronics Ltd.).

Based on the area (3 $cm^2$) of the magnet that is used and the distance (2 mm) between the electrodes, the value that is read out is converted into a volume specific resistance in compliance with the following formula, $$\text{Volume specific resistance } (\Omega\cdot\text{cm}) = \text{resistance } (\Omega)\times(3\ \text{cm}^2/0.2\ \text{cm})$$

The measuring environment is 20±2° C. and 65±5%RH, and the samples and the measuring device are kept in the above environment for not smaller than 8 hours in order to adjust the temperature and humidity of the samples and the measuring device to those of the environment.

Examples of the silicone resin for carrier coating may include SR2400 and SR2406 manufactured by Dow Corning Toray Silicone Co., and KR9706, KR271, KR255 and KR251 manufactured by Shin-etsu Chemical Co. The resin coating is formed by the fluidized layer spray drying method or the immersion method.

The carrier used in the present invention is obtained by coating the core agent with a silicone resin, followed by the heat treatment at about 150 to 250° C. for 1 to 3 hours, so that the silicone resin coating is cured to a sufficient degree. The thus obtained carrier exhibits resistance against abrasion even after repetitively used for extended periods of time, and features excellent resistance against being spent and long life.

The amount of electric charge by friction of the carrier is nearly equal to an absolute value of the amount of electric charge by friction possessed by the toner used for the electrostatic latent image developing agent of the present invention, but has an opposite polarity, and should, hence, lie within a range of from −10 to −20 μc/g. The amount of electric charge by friction of the carrier is adjusted by changing the conditions for heat-treating the above-mentioned coating. The amount of electric charge increases with an increase in the temperature of the heat treatment or with an increase in the heat-treating time.

As the magnetic particles constituting the carrier, there can be exemplified particles of iron, oxidized iron, reduced iron, ferrite, magnetite, copper, silicon steel, nickel or cobalt, particles of alloys thereof with manganese, zinc or aluminum, and particles obtained by dispersing the particles of the above-mentioned material in a binder resin. Among them, the ferrite particles are favorably used exhibiting a small change in the electric resistance caused by environment and aging, and forming soft ear upon contacting with the surface of the photosensitive material in a magnetic field in the developing device. As the ferrite particles, there can be exemplified particles of zinc ferrite, nickel ferrite, copper ferrite, nickel-zinc ferrite, manganese-magnesium ferrite, copper-magnesium ferrite, manganese-zinc ferrite, and manganese-copper-zinc ferrite.

(Developing agent)

In the two-component-type developing agent of the present invention, it is essential that the amount of electric charge by friction of the toner is within a range of from +10 to +20 μc/g. As the apparatus for measuring the amount of electric charge by friction, there has heretofore been used an apparatus for measuring the electric charge by blow-off friction manufactured by Toshiba Chemical Corp. In this apparatus, the amount of electric charge is measured by blowing the toner only with a nitrogen gas to the outer side of the Faraday gauge through a mesh. This, however, blows off even the so-called over-charged toner that is electrostatically adsorbed relatively strongly in the surfaces of the carrier. Therefore, the measured value tends to become higher than the amount of electric charge of the toner that is really used for the developing. In order to prevent the over-charged toner from being blown off, the blowing pressure may be lowered. According to this method, however, the blowing is not uniformly accomplished, and the measured value lacks stability.

In the present invention, the amount of electric charge effectively used for the developing must be correctly measured. Without relying on the traditional method, therefore, the amount of electric charge of the toner according to the present invention is measured by using a suction-type frictional charge measuring apparatus, Model STC-50, (manufactured by Sankyo Piotech Co., Ltd.) that is based on the method of softly isolating and sucking the toner only from the developing agent by the suction of the air through a mesh.

Figure 3:
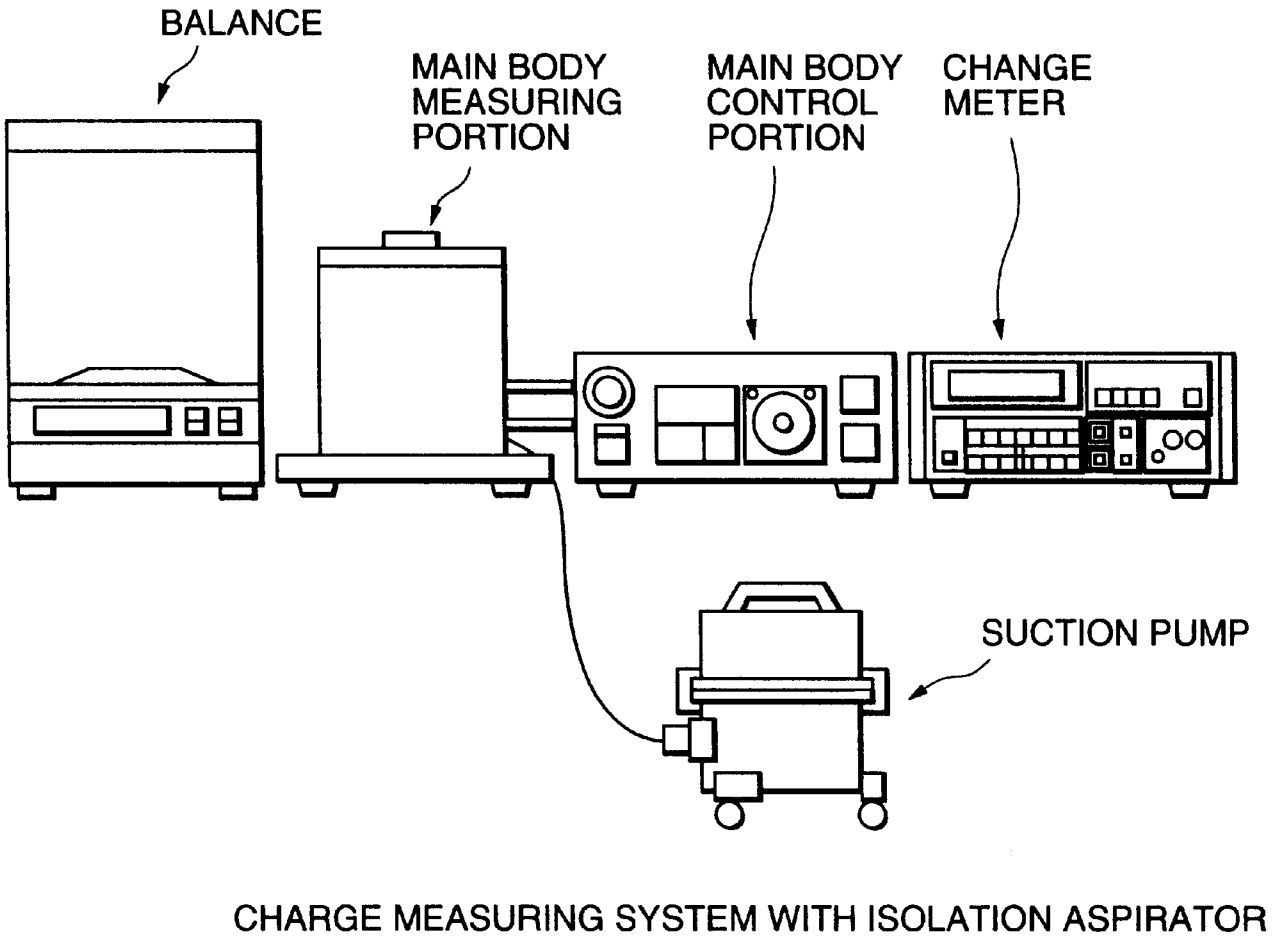
FIG. 3 is a schematic diagram of a frictional charge measuring apparatus of the suction type for measuring the amount of electric charge.
Figure 4:
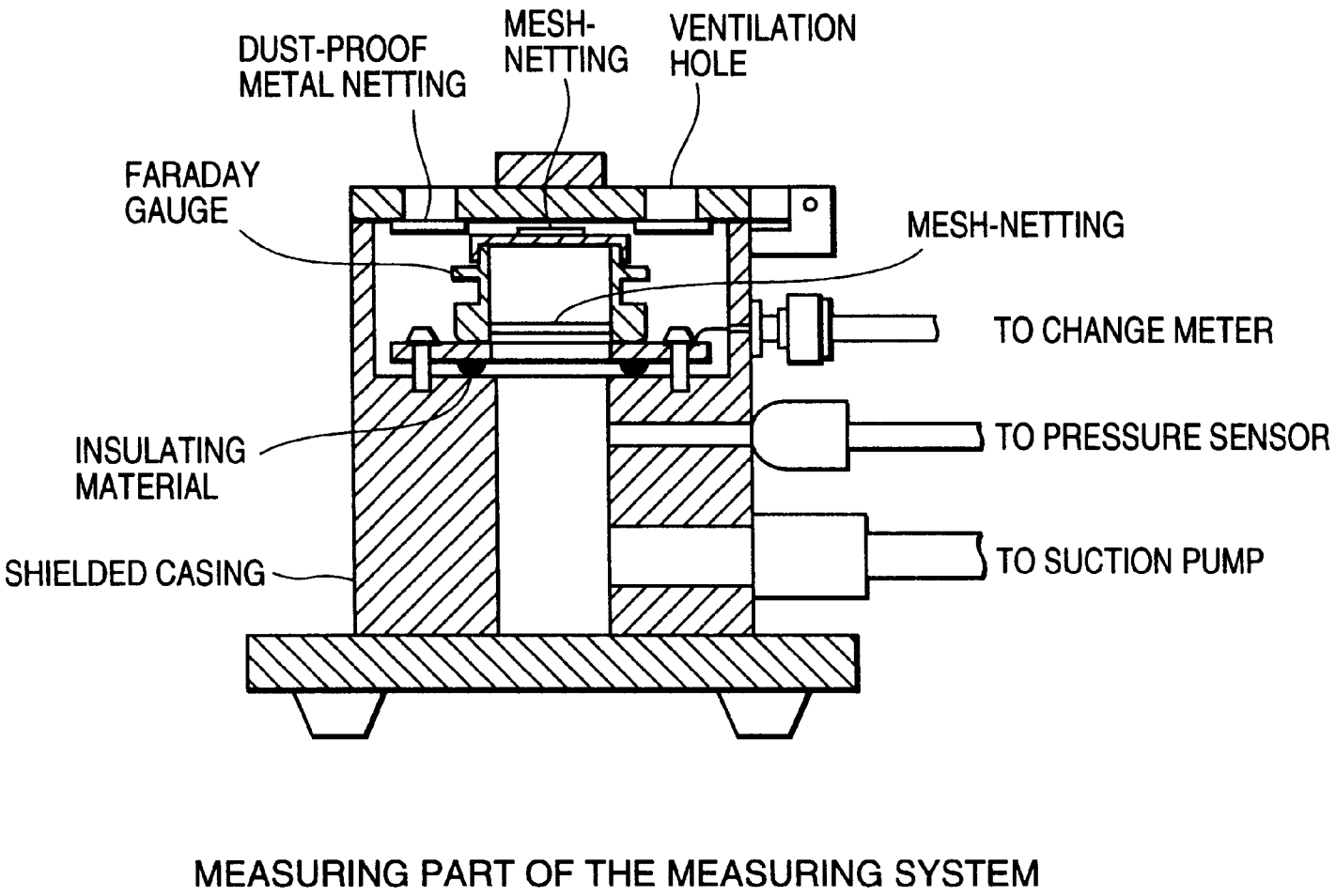
FIG. 4 is a schematic diagram of a measuring part in the measuring apparatus of FIG. 3.

FIG. 3 is a diagram schematically illustrating the above-mentioned suction-type frictional charge measuring apparatus STC-50, and FIG. 4 is a diagram schematically illustrating the measuring part shown in FIG. 3.

In this measuring apparatus, first, the weighed sample of developing agent is thrown into a sample chamber in the measuring part shown in FIG. 4 and is sucked. The amount of electric charge after the suction is read out, and the mass of the sample (carrier) remaining in the sample chamber is measured. The amount of electric charge of the toner is calculated in a manner as described below.

Amount of charge of toner (μc/g)=−(amount of charge read out)(μc)/{mass of sample before sucked (g)−mass of sample after sucked (g)}

The measuring environment is 20±2° C., 65±5%RH, a stainless steel gauze (400 mesh, ϕ33) is used as the mesh-netting of FIG. 4, the suction pressure is 0.3 kPa, and the suction time is 60 sec.

Similarly, the amount of electric charge of the carrier is calculated according to, Amount of charge of carrier (μc/g)=amount of electric charge read out (μc)/mass of sample after sucked (g)

The toner in the developing agent of the present invention is prepared by mixing a binder resin, wax, coloring agent, charge control agent and the like agent at a desired blending ratio, forming nucleating particles through the steps of melt-kneading, pulverization and classification, and adding various additives in order to impart fluidity, electrically charging property and effect for cleaning the photosensitive material. Examples of the binder resin for the toner used in the present invention include styrene resins (styrene or a homopolymer or a copolymer including styrene substituent) such as polystyrene, poly- a-methyl styrene, styrene-propylene copolymer, styrene-butadiene copolymer, styrene-vinyl acetate copolymer, styrene-maleic acid copolymer, styrene-acrylic acid ester copolymer (styrene-methyl acrylate copolymer, styrene-ethyl acrylate copolymer, styrene-butyl acrylate copolymer, etc.), styrene-methacrylic acid ester copolymer (styrene-methyl methacrylate copolymer, styrene-ethyl methacrylate copolymer, styrene-butyl methacrylate copolymer), styrene-a-methyl chloroacrylate copolymer, and styrene-acrylonitrile-acrylic acid ester copolymer, as well as ethylene-ethyl acrylate copolymer, ethylene-vinyl acetate copolymer, rosin-modified maleic acid resin, epoxy resin, and polyester resin, which may be used in a single kind or being mixed together in two or more kinds.

As a parting agent (offset-preventing agent) for the toner used in the present invention, there can be used, for example, aliphatic hydrocarbons, aliphatic metal salts, higher fatty acids, fatty acid esters or a partially saponified product thereof, silicone oil and waxes. Among them, it is desired to use aliphatic hydrocarbons having a weight average molecular weight of about 1000 to about 10,000. Concretely speaking, there can be used low-molecular polyethylene, low-molecular polypropylene, paraffin wax, and low-molecular olefin polymer comprising an olefin unit of not less than 4 carbon atoms, in one kind or in a combination of two or more kinds.

As the coloring agent for the toner used in the present invention, there can be used a color pigment or a color dye used for the ordinary color toners in addition to carbon black. As the carbon black, there can be used channel black, gas furnace black, oil furnace black, thermal black or acetylene black. As the coloring agent, there can be used azo or benzidine pigment (for yellow toner), quinacridone pigment (for magenta toner), or copper phthalocyanine pigment (for cyan toner).

As the charge control agent for controlling the positive charge used in the present invention, there can be exemplified nigrosine dye, aminopyrin, pyrimidine compound, polynucleic polyamino compound, aminosilanes or quaternary ammonium salt.

There can be further suitably added treating agents such as hydrophobic silica, titanium oxide, alumina, magnetite and fine particles such as acrylic resin powder.

It is desired that the parting agent for toner is used in an amount of from 1 to 10 parts by weight, the coloring agent for toner is used in an amount of from 3 to 20 parts by weight, and the charge control agent is used in an amount of from 1 to 10 parts by weight per 100 parts by weight of the binder resin.

In the developing agent of the present invention, the toner concentration is preferably in a range of from 3.0 to 5.0% by weight. When the toner concentration is smaller than 3.0%, the image density decreases. When the toner concentration exceeds 5.0%, the toner scatters and causes fogging, and the forward dragging phenomenon tends to occur in a highly humid environment.

In the two-component-type developing agent of the present invention comprising the positively charging toner and the magnetic carrier, the amount of electric charge by friction remains stable even after repetitively used for extended periods of time maintaining favorable image quality such as image density and fogging density, preventing white spots on the image caused by the adhesion of carrier on the photosensitive material and black stripes on the image due to the scratch on the photosensitive material, and further effectively preventing copy fouling caused by the scattering of toner in the machine, forward dragging of the image and blurring in a highly humid environment.

EXAMPLES

The invention will now be concretely described by way of Examples.

Preparation of toner:

| | |
|---|---|
| Styrene/n-butyl methacrylate copolymer (weight average molecular weight of 300,000 and number average molecular weight of 8,000) | 100 parts by weight |
| NP055 (low-molecular polypropylene manufactured by Mitsui Chemical Inc.) | 2 parts by weight |
| Printex 90 (carbon black manufactured by Degussa Co.) | 6 parts by weight |
| Nigrosine dye | 3 parts by weight |

The above-mentioned materials were subjected to the steps of mixing (Henschel's mixer)→kneading (biaxial extruder)→coarse pulverization (hammer mill)→fine pulverization (jet mill)→classification (wind classifier) to obtain toner particles having an average diameter of 9.5 μm.

| | |
|---|---|
| Toner particles | 100 parts by weight |
| Silica (treated with aminohexyltriethoxysilane, average diameter of 10 nm) | 0.3 parts by weight |
| Titanium oxide (average particle diameter of 50 nm) | 0.2 parts by weight |

The above-mentioned materials were mixed together at a high speed using the Henschel's mixer to obtain a product toner.

Example 1

1000 Parts by weight of a ferrite core material having an average particle diameter of 90 μm and a saturation magnetization of 60 emu/g was spray-coated with a coating agent comprising the following components by using a fluidized layer-coating device, and was heat-treated at 210° C. for 90 minutes to prepare a carrier.

Coating agent:

| | |
|---|---|
| KR251 (straight silicone resin manufactured by Shin-etsu Chemical Co., Ltd. solid content of 50%) | 9.0 parts by weight |
| Printex L (carbon black manufactured by Degussa Co.) | 0.045 parts by weight |
| Solvent (toluene) | 500 parts by weight |

The average thickness of the coating on the carrier calculated from the specific surface area of the carrier and the amount of the coating resin was 0.2 μm, and the volume specific resistance of the carrier measured by the bridge method was $7.5\times10^9$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +15.3 μc/g.

The results of Example 1 were as shown in Table 1.

Example 2

A carrier was prepared by using the same materials and by the same method as those of Example 1 but changing the temperature of the heat treatment to be 200° C.

The average thickness of the coating on the carrier calculated from the specific surface area of the carrier and the amount of the coating resin was 0.2 μm, and the volume specific resistance of the carrier measured by the bridge method was $3\times10^9$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +12.9 μc/g.

The results of Example 2 were as shown in Table 1.

Example 3

A carrier was prepared by using the same materials and by the same method as those of Example 1 but changing the temperature of the heat treatment to be 220° C. and the heat-treatment time to be 120 minutes.

The average thickness of the coating on the carrier calculated from the specific surface area of the carrier and the amount of the coating resin was 0.2 μm, and the volume specific resistance of the carrier measured by the bridge method was $1.05\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +19.7 μc/g.

The results of Example 3 were as shown in Table 1.

Example 4

A carrier was prepared by using the same materials and by the same method as those of Example 1 but changing the temperature of the heat treatment to be 225° C., the heat-treatment time to be 120 minutes, the particle diameter of the ferrite core material to be 65 μm, the amount of addition of the silicone resin KR251 to be 20 parts by weight and the amount of carbon addition to be 0.1 part by weight.

The average thickness of the coating on the carrier calculated from the specific surface area of the carrier and the amount of the coating resin was 0.22 μm, and the volume specific resistance of the carrier measured by the bridge method was $1.05\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +17.2 μc/g.

The results of Example 4 were as shown in Table 1.

Example 5

A carrier was prepared by using the same materials and by the same method as those of Example 1 but changing the temperature of the heat treatment to be 225° C., the heat-treatment time to be 120 minutes, the particle diameter of the ferrite core material to be 105 μm, the amount of addition of the silicone resin KR251 to be 6.5 parts by weight and the amount of carbon addition to be 0.032 part by weight.

The average thickness of the coating on the carrier calculated from the specific surface area of the carrier and the amount of the coating resin was 0.2 μm, and the volume specific resistance of the carrier measured by the bridge method was $6\times10^{9}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be 12.1 μc/g.

The results of Example 5 were as shown in Table 1.

Example 6

A carrier was prepared by using the same materials and by the same method as those of Example 1 but changing the amount of addition of the silicone resin KR251 to be 5.0 parts by weight, the amount of addition of carbon black to be 0.025 parts by weight, and the heat-treatment time to be 105 minutes.

The average thickness of the coating on the carrier calculated from the specific surface area of the carrier and the amount of the coating resin was 0.11 μm, and the volume specific resistance of the carrier measured by the bridge method was $4.5\times10^{8}$ Ω·cm.

95 Parts by weight of the carrier and 5 parts by weight of the positively charging toner were mixed together by using the Labomixer (manufactured by Hosakawa Micron Co.) to prepare a developing agent, and the amount of electric charge of the toner was measured to be +16.9 μc/g.

The results of Example 6 were as shown in Table 1.

Example 7

A carrier was prepared by using the same materials and by the same method as those of Example 1 but changing the amount of addition of the silicone resin KR251 to be 13 parts by weight and the amount of carbon addition to be 0.065 parts by weight.

The average thickness of the coating on the carrier calculated from the specific surface area of the carrier and the amount of the coating resin was 0.3 μm, and the volume specific resistance of the carrier measured by the bridge method was $7.5\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +13.3 μc/g.

The results of Example 7 were as shown in Table 1.

Example 8

A carrier was prepared by using the same materials and by the same method as those of Example 4 but changing the particle diameter of the ferrite core metal to be 65 μm, the content of the carrier having diameters of not larger than 44 μm to be 2.5% by weight.

The average thickness of the coating on the carrier calculated from the specific surface area of the carrier and the amount of the coating resin was 0.2 μm, and the volume specific resistance of the carrier measured by the bridge method was $1.1\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +17.5 μc/g.

The results of Example 8 were as shown in Table 1.

Comparative Example 1

A carrier was prepared by using the same materials and by the same method as those of Example 1 but changing the particle diameter of the ferrite core material to be 45 μm, the amount of addition of the silicone resin KR251 to be 24 parts by weight, the amount of addition of carbon black to be 0.12 parts by weight, the temperature of the heat treatment to be 220° C., and the heat-treating time to be 120 minutes.

The average thickness of the coating on the carrier calculated from the specific surface area of the carrier and the amount of the coating resin was 0.18 μm, and the volume specific resistance of the carrier measured by the bridge method was $1.35\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +18.5 μc/g.

The results of Comparative Example 1 were as shown in Table 2.

Comparative Example 2

A carrier was prepared by using the same materials and by the same method as those of Example 1 but changing the particle diameter of the ferrite core material to be 130 μm, the amount of addition of the silicone resin KR251 to be 4.5 parts by weight, the amount of addition of carbon black to be 0.022 parts by weight, the temperature of the heat treatment to be 220° C., and the heat-treating time to be 120 minutes.

The average thickness of the coating on the carrier calculated from the specific surface area of the carrier and the amount of the coating resin was 0.2 μm, and the volume specific resistance of the carrier measured by the bridge method was $4.5\times10^{9}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +10.6 μc/g.

The results of Comparative Example 2 were as shown in Table 2.

Comparative Example 3

A carrier was prepared by using the same materials and by the same method as those of Example 1 but changing the temperature of the heat treatment to be 180° C., and the heat-treating time to be 60 minutes.

The average thickness of the coating on the carrier calculated from the specific surface area of the carrier and the amount of the coating resin was 0.2 μm, and the volume specific resistance of the carrier measured by the bridge method was $1.2\times10^{9}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +8.5 μc/g.

The results of Comparative Example 3 were as shown in Table 2.

Comparative Example 4

A carrier was prepared by using the same materials and by the same method as those of Example 1 but changing the temperature of the heat treatment to be 230° C., and the heat-treating time to be 150 minutes.

The average thickness of the coating on the carrier calculated from the specific surface area of the carrier and the amount of the coating resin was 0.2 μm, and the volume specific resistance of the carrier measured by the bridge method was $1.5\times10^{10}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +21.8 μc/g.

The results of Comparative Example 4 were as shown in Table 2.

Comparative Example 5

A carrier was prepared by using the same materials and by the same method as those of Example 1 but changing the amount of addition of the silicone resin KR251 to be 3.0 parts by weight, the amount of addition of carbon to be 0.015 parts by weight, and the heat-treating time to be 105 minutes.

The average thickness of the coating on the carrier calculated from the specific surface area of the carrier and the amount of the coating resin was 0.07 μm, and the volume specific resistance of the carrier measured by the ridge method was $1.2\times10^{8}$ Ω·cm.

95 Parts by weight of the carrier and 5 parts by eight of the positively charging toner were mixed together by using the Labomixer (manufactured by Hosokawa Micron Corp.) to prepare a developing agent, and the amount of electric charge of the toner was measured to be +18.1 μc/g.

The results of Comparative Example 5 were as shown in Table 2.

Comparative Example 6

A carrier was prepared by using the same materials and by the same method as those of Example 1 but changing the amount of addition of the silicone resin KR251 to be 18 parts by weight, the amount of addition of carbon to be 0.09 parts by weight, and the temperature of the heat-treating time to be 220° C.

The average thickness of the coating on the carrier calculated from the specific surface area of the carrier and the amount of the coating resin was 0.41 μm, and the volume specific resistance of the carrier measured by the bridge method was $4.5\times10^{11}$ Ω·cm.

95 Parts by weight of the carrier and 5 parts by weight of the positively charging toner were mixed together by using the Labomixer (manufactured by Hosokawa Micron Corp.) to prepare a developing agent, and the amount of electric charge of the toner was measured to be +11.9 μc/g.

The results of Comparative Example 6 were as shown in Table 2.

By using nine kinds of developing agents comprising the positively charging toners and the carriers obtained as described above, the test was conducted for obtaining 100,000 pieces of copies using a copying machine, Creage 7325, manufactured by Mita Industrial Co., Ltd. (note: in Comparative Examples 1, 2, 3 and 4, the satisfactory initial image quality was not obtained as will be described later, and the operation was discontinued after the initial stage of copying operation). The results were as shown in Tables 1 and 2.

The amounts of electric charge during the initial operation and after 100,000 pieces of copies were obtained, and the toner concentration after 100,000 pieces of copies were obtained in Tables 1 and 2, were measured by using a suction-type frictional charge measuring apparatus, Model STC-50 (manufactured by Sankyo Piotech Co., Ltd.). The measuring conditions consisted of a suction pressure of 0.3 kPa and a suction time of 60 seconds.

The image density (ID) and the fogging density (FD) in Tables 1 and 2 were measured by using a reflection density measuring apparatus manufactured by Nippon Denshoku Industries Co., Ltd. The image density is a value of measurement of a solid black portion. The fogging density is obtained by subtracting the reflection density of a white paper of before being copied from the reflection density of the non-image portion after copied. The image density was evaluated to be acceptable when it was not smaller than 1.3 and to be not acceptable when it was smaller than 1.3. The fogging density was evaluated to be acceptable when it was not larger than 0.005 and to be not acceptable when it was not smaller than 0.006.

The forward carrier dragging was evaluated based on the blurring caused by the scattering of the toner on the front side of the solid image of when the copying operation was resumed 12 hours after the copier was left to stand in an environment of 29° C. 90%. The white spot on the image was evaluated based on the presence of white spots in the solid image which was the wholly black chart.

The fouling of copy after 200,000 pieces were obtained was evaluated depending upon whether the toner scattering from the developing agent on the developing sleeve fell on the transfer paper conveyer portion to contaminate the back side of the copy.

The black stripes cause the image to become defective as the carrier caught between the cleaning blade and the photosensitive material drum scratches the circumference of the photosensitive material in the cleaning portion.

Results of Copying Test:

The results of copying in Examples were as shown in Table 1 and the results of copying in Comparative Examples were as shown in Table 2.

Examples 1 to 7

Favorable image quality was maintained from the first copy through up to 200,000-th copy.

Example 8

Good image quality was maintained in the initial stage, though white spots were slightly formed in the image due to the carrier dragging.

Comparative Example 1

The initial image density was 1.21 which failed to satisfy the reference (not smaller than 1.3), and white spots were formed in the image due to the carrier dragging.

Comparative Example 2

The initial fogging density was 0.011 which failed to satisfy the reference (not larger than 0.005), and the forward dragging occurred in a highly humid environment (28° C., 90%).

Comparative Example 3

The initial amount of electric charge was as low as +8.5 μc/g, the fogging density was 0.010 which failed to satisfy the reference (not larger than 0.005), and the forward dragging occurred in a highly humid environment (28° C., 90%).

Comparative Example 4

The initial amount of electric charge was as high as +21.8 μc/g, and the image density was 1.23 which failed to satisfy the reference (not smaller than 1.3).

Comparative Example 5

The initial amount of electric charge was +18.1 μc/g and there was no problem in the image density and fogging density in the initial stage. However, white spots were observed due to the carrier dragging to the image portion.

Further, forward carrier dragging occurred in a highly humid environment (28° C., 90%). After 200,000 pieces of copies have been obtained, the amount of electric charge greatly dropped down to +9.1 μc/g developing the fogging density of not smaller than the reference (0.009 relative to the value of not larger than 0.005). After 100,000 pieces of copies have been obtained, the toner scattered much from the developing agent, and the back surface of the copy was fouled due to the scattering of toner that had been deposited on the lower side of the developing device. Further, black stripes were observed in the circumferential direction of the photosensitive material drum, and scars were observed on the portions of the photosensitive material corresponding to the black stripes.

Comparative Example 6

The initial image density was 1.21 which failed to satisfy the reference (not smaller than 1.3). After 200,000 pieces of copies have been obtained, the amount of electric charge has dropped down to +8.3 μc/g developing the fogging density of not smaller than the reference (0.012 relative to the value of not larger than 0.005). The toner scattered much from the developing agent, and the back surface of the copy was fouled due to the scattering of toner that had been deposited on the lower side of the developing device.

TABLE 1

| | Example 1 | Example 2 | Example 3 | Example 4 | Example 5 | Example 6 | Example 7 | Example 8 |
|---|---|---|---|---|---|---|---|---|
| Object of study | Intermediate charging amount | Lower limit of charging amount | Upper limit of charging amount | Lower limit of particle diameter | Upper limit of particle diameter | Lower limit of coating thickness | Upper limit of coating thickness | |
| Core diameter(pin) | 90 | 90 | 90 | 65 | 105 | 90 | 90 | 65 |
| Core specific surface area ($cm^2/g$) | 220 | 220 | 220 | 450 | 165 | 220 | 220 | 470 |
| KR251 parts by weight (Si solid content 50 wt %) | 9 | 9 | 9 | 20 | 6.5 | 5 | 13 | 19 |
| C parts by wt. | 0.045 | 0.045 | 0.045 | 0.1 | 0.032 | 0.025 | 0.065 | 0.1 |
| Heat-treating temp. (° C.) | 210 | 200 | 220 | 225 | 225 | 210 | 210 | 225 |
| Heat-treating time (min) | 90 | 90 | 120 | 120 | 120 | 105 | 90 | 120 |
| Coat thickness (μm) | 0.2 | 0.2 | 0.2 | 0.22 | 0.2 | 0.11 | 0.3 | 0.2 |
| Carrier resistance(Ω · cm) | $7.5 \times 10^9$ | $3 \times 10^9$ | $1.05 \times 10^{10}$ | $1.05 \times 10^{10}$ | $6 \times 10^9$ | $4.5 \times 10^8$ | $7.5 \times 10^{10}$ | $1.1 \times 10^{10}$ |
| Content of | 1.2 | 1.2 | 1.2 | 2.0 | 0.8 | 1.2 | 1.2 | 2.5 |

TABLE 1-continued

| | Example 1 | Example 2 | Example 3 | Example 4 | Example 5 | Example 6 | Example 7 | Example 8 |
|---|---|---|---|---|---|---|---|---|
| carriers having diameter of not larger than 44 μm (wt %) | | | | | | | | |
| Initial | | | | | | | | |
| Toner concentration (%) | 5.0 | 5.0 | 5.0 | 5.0 | 5.0 | 5.0 | 5.0 | 5.0 |
| Amount of charge (+μc/g) | 15.3 | 12.9 | 19.7 | 17.2 | 12.1 | 16.9 | 13.3 | 17.5 |
| FD (less than 1.30:X) | 1.41 | 1.45 | 1.35 | 1.35 | 1.44 | 1.41 | 1.35 | 1.34 |
| | ○ | ○ | ○ | ○ | ○ | ○ | ○ | ○ |
| FD (0.006 or more:X) | 0.000 | 0.002 | 0.000 | 0.000 | 0.004 | 0.002 | 0.001 | 0.002 |
| | ○ | ○ | ○ | ○ | ○ | ○ | ○ | ○ |
| Forward dragging(28° C. 90%) | no | no | no | no | no | no | no | no |
| White spot | no | no | no | no | no | no | no | slightly |
| After 100,000 pieces | | | | | | | | |
| Toner concentration (%) | 3.8 | 4.3 | 3.6 | 4.1 | 4.4 | 4.4 | 4.6 | |
| Amount of charge (+μc/g) | 14.1 | 41.8 | 18.6 | 16.3 | 11.5 | 15.2 | 12.4 | |
| ID (less than 1.30:X) | 1.39 | 1.43 | 1.31 | 1.42 | 1.39 | 1.38 | | |
| | ○ | ○ | ○ | ○ | ○ | ○ | ○ | |
| FD (0.006 or more:X) | 0.002 | 0.003 | 0.001 | 0.001 | 0.003 | 0.003 | 0.003 | |
| | ○ | ○ | ○ | ○ | ○ | ○ | ○ | |
| Copy fouling | no | no | no | no | no | no | no | |
| Black stripes | no | no | no | no | no | no | no | |
| Overall evaluation (○: good, X: poor) | ○ | ○ | ○ | ○ | ○ | ○ | ○ | |

TABLE 2

| | Comparative Example 1 | Comparative Example 2 | Comparative Example 3 | Comparative Example 4 | Comparative Example 5 | Comparative Example 6 |
|---|---|---|---|---|---|---|
| Object of study | Under-particle diameter | Over-particle diameter | Under-charging amount | Over-charging amount | Under-coating thickness | Over-coating thickness |
| Core diameter (μm) | 45 | 130 | 90 | 90 | 90 | 90 |
| Core specific surface area ($cm^2/g$) | 650 | 115 | 220 | 220 | 220 | 220 |
| KR251 parts by weight (Si solid content 50 wt %) | 24 | 4.5 | 9 | 9 | 3 | 18 |
| C parts by wt. | 0.12 | 0.022 | 0.045 | 0.045 | 0.015 | 0.090 |
| Heat-treating temp. (° C.) | 220 | 220 | 180 | 230 | 210 | 220 |
| Heat-treating time (min) | 120 | 120 | 60 | 150 | 105 | 90 |
| Coat thickness (μm) | 0.18 | 0.2 | 0.2 | 0.2 | 0.7 | 0.41 |
| Carrier resistance (Ω · cm) | $1.35 \times 10^{10}$ | $4.5 \times 10^{9}$ | $1.2 \times 10^{9}$ | $1.5 \times 10^{10}$ | $1.2 \times 10^{108}$ | $4.5 \times 10^{11}$ |
| Content of carriers having diameter of not larger than 44 μm (wt %) | 30 | 0.4 | 1.2 | 1.2 | 1.2 | 1.2 |
| Initial | | | | | | |
| Toner concentration (%) | 5.0 | 5.0 | 5.0 | 5.0 | 5.0 | 5.0 |
| Amount of charge (+μc/g) | 18.5 | 10.6 | 8.5 | 21.8 | 18.1 | 11.9 |
| ID (less than 1.30:X) | 1.21 | 1.46 | 1.51 | 1.23 | 1.38 | 1.21 |
| | X | ○ | ○ | X | ○ | ○ |
| FD (0.006 or more:X) | 0.001 | 0.011 | 0.010 | 0.002 | 0.003 | 0.005 |
| | ○ | X | X | ○ | ○ | ○ |
| Forward dragging (28° C. 90%) | no | yes | yes | no | yes | no |
| White spot | yes | no | no | no | yes | no |
| After 100,000 pieces | | | | | | |
| Toner concentration (%) | | | | | 5.7 | 5.6 |
| Amount of charge (+μc/g) | | | | | 9.1 | 8.3 |
| ID (less than 1.30:X) | | | | | 1.48 | 1.44 |
| | | | | | ○ | ○ |
| FD (0.006 or more:X) | | | | | 0.09 | 0.012 |

TABLE 2-continued

| | Comparative Example 1 | Comparative Example 2 | Comparative Example 3 | Comparative Example 4 | Comparative Example 5 | Comparative Example 6 |
|---|---|---|---|---|---|---|
| | | | | | X | X |
| Copy fouling | | | | | yes | yes |
| Black stripes | | | | | yes | no |
| Overall evaluation (○: good, X: poor) | X | X | X | X | X | X |

What is claimed is:

1. A carrier for electrostatic latent image developing having a resin coating of a cured product of a silicone resin applied onto the surfaces of carrier cores, the average particle diameter thereof being from 60 to 110 μm, the thickness of the resin coating being from 0.1 to 0.3 μm, the volume specific resistance thereof being from $1.5\times10^{8}$ to $1.5\times10^{11}$ Ω·cm, and the amount of electric charge by friction being from −10 to −20 μc/g.

2. A carrier according to claim 1, wherein the particles having diameters of not larger than 44 μm are contained in amounts of not larger than 2% by weight.

3. A developing agent for electrostatic latent image, which is a two-component-type developing agent comprising a silicone resin-coated carrier and a positively charging toner, said silicone resin-coated carrier having an average particle diameter of from 60 to 110 μm, the thickness of the resin coating being from 0.1 to 0.3 μm, and the volume specific resistance thereof being from $1.5\times10^{8}$ to $1.5\times10^{11}$ Ω·cm, and said positively charging toner having the amount of electric charge by friction being from +10 to +20 μc/g.

4. A developing agent for electrostatic latent image according to claim 3, wherein the content of the toner is from 3.0 to 5.0% by weight.

* * * * *